United States Patent [19]

Lehman

[11] Patent Number: 4,684,772

[45] Date of Patent: Aug. 4, 1987

[54] MOUNTING APPARATUS FOR ARC QUENCHING PLATES FOR ELECTRIC CONTACTS

[75] Inventor: Lewis M. Lehman, Brown Deer, Wis.

[73] Assignee: Square D Company, Palatine, Ill.

[21] Appl. No.: 721,984

[22] Filed: Apr. 9, 1985

[51] Int. Cl.[4] ..... H01H 33/08

[52] U.S. Cl. ..... 200/144 R; 200/306

[58] Field of Search ..... 200/144 R, 148 C, 304, 200/305, 306

[56] References Cited

U.S. PATENT DOCUMENTS

| | | | |
|---|---|---|---|
| 2,788,421 | 4/1957 | Jones | 200/144 R |
| 3,025,376 | 3/1962 | Yarrick | 200/148 C |
| 3,091,677 | 5/1963 | Rosing | 200/144 R |
| 3,448,231 | 6/1969 | Heft | 200/144 R |
| 3,515,829 | 6/1970 | Hurtle et al. | 200/144 R |
| 3,662,133 | 5/1972 | Bould et al. | 200/144 R |
| 3,706,868 | 12/1972 | Rys | 200/144 R |
| 4,345,225 | 8/1982 | Lemmer | 335/202 |
| 4,401,863 | 8/1983 | Lemmer et al. | 200/144 R |
| 4,446,347 | 5/1984 | Eguchi et al. | 200/144 R |
| 4,477,704 | 10/1984 | Mori et al. | 200/144 R |
| 4,485,283 | 11/1984 | Hurtle | 200/144 R |

FOREIGN PATENT DOCUMENTS

| | | | |
|---|---|---|---|
| 212415 | 12/1960 | Austria | 200/144 R |
| 1108488 | 1/1956 | France | 200/144 R |
| 2511188 | 2/1983 | France | 200/144 R |
| 352903 | 9/1937 | Italy | 200/144 R |
| 851517 | 7/1981 | U.S.S.R. | 200/144 R |

*Primary Examiner*—Robert S. Macon

*Attorney, Agent, or Firm*—A. Sidney Johnston; Richard T. Guttman

[57] ABSTRACT

There are provided arc quenching plates for leading an arc formed by operation of electric contacts away from the contacts, and there is provided a housing for holding the arc quenching plates. The housing has grooves made into opposing internal walls, and the grooves extend from a first side of the housing for a predetermined distance into the housing, the arc quenching plates are insertable from the first side of the housing into the grooves, and a retaining plate holds the arc quenching plates in place in the grooves. The retaining plate may have an exhaust channel between the housing and the retaining plate for exhaust of arc gases in a direction substantially parallel to a plane of the retaining plate, and substantially perpendicular to a plane of the arc quenching plates.

21 Claims, 46 Drawing Figures

MOUNTING APPARATUS FOR ARC QUENCHING PLATES FOR ELECTRIC CONTACTS

FIELD OF THE INVENTION

This invention relates to mounting apparatus for arc quenching plates for electric contacts, and more particularly for mounting apparatus adaptable to automatic machine insertion of arc quenching plates during assembly of the apparatus.

BACKGROUND OF THE INVENTION

Arc quenching plates are used in conjunction with electrical contacts, for example in circuit breakers or, for example, in electromagnetically operated contactors. The arc quenching plates serve the purpose of leading an arc away from the contacts, where the arc is produced as the contacts open. Leading the arc away from the contacts facilitates extinguishing the arc. Arc quenching plates have in the past been mounted in a variety of methods, none of which lend themselves to easy assembly of the arc quenching plates in the body of an electromagnetic contactor or in a circuit breaker, so that the assembly can be automated. Automation may be, for example, by a robot assembly step. A further consideration in mounting an arc quenching system is to direct the exhaust of arc gases so as to minimize the danger of injury to a person who is working on the electrical system.

An example of arc quenching plates assembled into an electromagnetic contactor is shown in U.S. Pat. No. 4,446,347, issued to Eguchi, et al., on May 1, 1984. In the Eguchi reference the arc quenching plates are mounted in slots in a two part mounting block, and the parts of the mounting block are held together by bolts. Also arc gases are vented in a direction substantially parallel to a plane of the arc quenching plates.

Another example of mounting arc quenching plates in a frame and securing them by bolts is shown in U.S. Pat. No. 3,091,677, issued to Rosing on May 28, 1963.

In U.S. Pat. No. 3,448,231, issued to Heft, on June 3, 1969, there is shown a system for retaining arc quenching plates by inserting ears formed in the plates into retaining slots formed into mounting plates. The mounting plates are then placed into the structure by insertion into matching openings, and retained by a louvered structure bolted into place.

An example of arc quenching plates retained within slots formed in a two part housing which is assembled together by bolts, and which has angled slots in a front retaining member for venting of exhaust gases is shown in U.S. Pat. No. 3,515,829, issued to Hurtle, et al., on June 2, 1970. The arc gas venting channels of the Hurtle, et al. reference prevent insertion of the arc quenching plates from outside of an assembled housing.

Arc quenching plates mounted internally to a housing for an electric contact device are shown in U.S. Pat. No. 4,401,863, issued to Lemmer, et al., on Aug. 30, 1983. The mounting for the plates shown in the Lemmer reference does direct the arc gases to the side of the device, but the plates are not conveniently arranged for robot insertion within the apparatus.

SUMMARY OF THE INVENTION

The invention solves the problem of a simple mounting of arc quenching plates for an electrical contact device so that the plates may be assembled into the apparatus by an automated assembly procedure. There are provided arc quenching plates for leading an arc formed by operation of the contacts away from the contacts, and there is provided a housing for holding the arc quenching plates. The housing has grooves made into opposing internal walls, and the grooves extend from a first side of the housing for a predetermined distance into the housing, the arc quenching plates are insertable from the first side of the housing into the grooves, and a retaining plate holds the arc quenching plates in place in the grooves. The retaining plate may have an exhaust channel between the housing and the retaining plate for exhaust of arc gases in a direction substantially parallel to a plane of the retaining plate, and substantially perpendicular to a plane of the arc quenching plates.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views:

FIG. 21 is an end view of an assembled contactor.

FIG. 22 is an exploded view of a contactor.

FIG. 23 is a sectional view of a contactor.

FIG. 24 is a top view of a lower housing.

FIG. 25 is a bottom view of an upper housing.

FIG. 26 is a section view of an upper housing.

FIG. 27 is an isometric view of a middle housing.

FIG. 28 is a section view of a lower housing.

FIG. 29 is a section view of a lower housing.

FIG. 30 is a functional diagram of a contactor.

FIG. 31 is a top view of a coil assembly.

FIG. 32 is a side view of a coil assembly.

FIG. 33 is a sectional view of a connection lug.

FIG. 34 is a top view of two bobbins.

FIG. 35 shows the electrical connection of coils wrapped on two bobbins.

FIG. 36 is an isometric view of a coil cup.

FIG. 37 is a top view of a coil assembly.

FIG. 38 is a side view of a coil assembly.

FIG. 39 is a detail view of a coil assembly.

FIG. 40 is a sectional view along a section line shown in FIG. 39.

FIG. 41 is a top view of a lug detail.

FIG. 42 is a sectional view along lines 42—42 shown in FIG. 41 of lug mounting detail.

FIG. 43 is a sectional view along line 43—43 shown in FIG. 42 showing lug mounting detail.

FIG. 44 is a top view of a coil assembly.

FIG. 45 is a side view of a coil assembly.

FIG. 46 is a sectional view taken along line 46—46 shown in FIG. 44, and showing lug mounting detail.

DETAILED DESCRIPTION

U.S. patent applications related to the present application and assigned to the assignee of this application include the following: "Hand Protector Shield for Electrical Apparatus". inventors L. M. Lehman, et al, Ser. No. 721,988, now abandoned continued as Ser. No. 008,092, filed Jan. 21, 1987 "Auxiliary Electrical Contact for Electromagnetic Contactor", inventors L. M. Lehman, et al, Ser. No. 721,986 now abandoned and continued as Ser. No. 028,067, filed Feb. 5, 1987; "Terminal Structure for a Coil", inventors J. Schmiedel, et al, Ser. No. 721,983 filed Apr. 9, 1985; "Coil Apparatus for Electromagnetic Contactor", inventors J. Schmiedel, et al, Ser. No. 721,985, now issued as U.S. Pat. No. 4,647,886, all disclosures of which are incorporated herein by reference.

Figure 1:
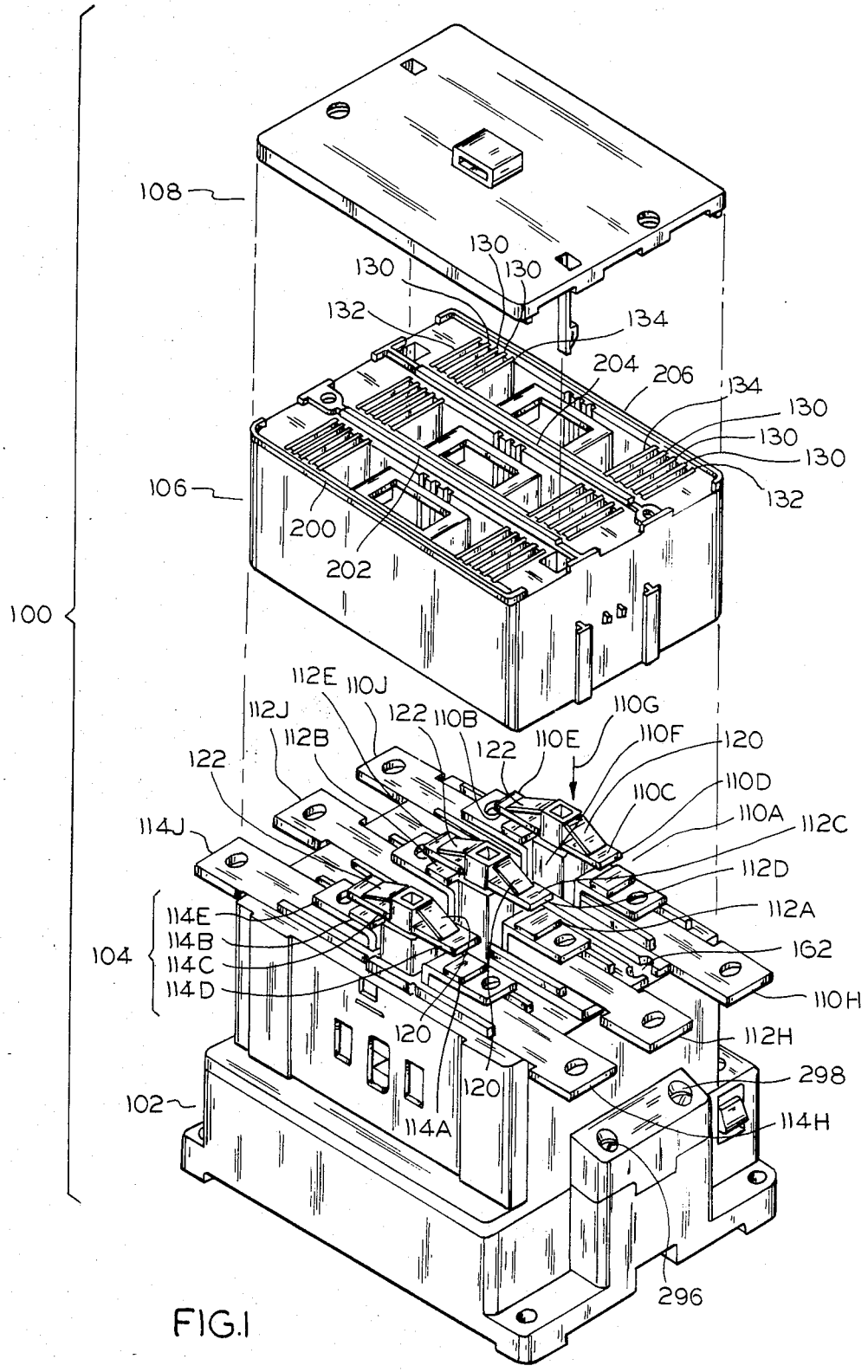
FIG. 1 is an exploded isometric view of an electromagnetic contactor.

A first embodiment of the invention is shown in FIG. 1–FIG. 19. In FIG. 1 there is shown an isometric exploded view of an electromagnetic contactor 100 having a lower housing 102, a middle housing 104, an upper housing 106, and a retainer plate 108. An electric switch is formed by stationary contact 110A and stationary contact 110B, and contact bridge 110C which carries movable contact 110D and movable contact 110E. The contacts are shown in the "open" position in FIG. 1. Arm 110F of the carrier 111 (shown in FIGS. 4, 15, 19) moves in the direction shown by arrow 110G when the magnet coil 113 (shown in FIGS. 4, 14, 19) of the contactor 100 is energized. Motion of arm 110F in direction 110G causes contact bridge 110C to move in direction of arrow 110G thereby bringing movable contact 110D into electrical connection with stationary contact 110A, and also bringing movable contact 110E into electrical contact with stationary contact 110B. Thus, when the magnet coil of contactor 100 is energized, an electrical connection is established between terminal 110H and terminal 110J. Likewise, when the magnet of contactor 100 is energized an electrical connection is established between terminal 112H and terminal 112J, through stationary contact 112A, movable contact 112D attached to contact bridge 112C, movable contact 112E, also attached to contact bridge 112C, and stationary contact 112B. Similarly, electrical contact is established between terminal 114H and 114J through contact bridge 114C carrying movable contacts 114D, 114E into electrical connection with stationary contact 114A and stationary contact 114B. Contactor 100 provides an electromagnetically operated switch for electric current, for example, three phase alternating current.

Leaf springs 120 and 122 are pulled in the direction of arrow 110G by contact carrier 110F, and bear against contact bridge 110C in order to insure that movable contacts 110D and 110E both bear with substantially equal force against their respective stationary contacts, 110A and 110B. Similarly, contact bridges 112C and 114C have leaf springs, also given reference numerals 120, 122, in order to press the respective contact bridges to insure that substantially equal force is applied to the contacts on each end of the contact bridges. De-energization of the magnet coil 114 of contactor 100 results in the three sets of contacts for terminals 110H, 110J, and 112H, 112J, and 114H, 114J, opening and taking the position shown in FIG. 1.

Figure 2:
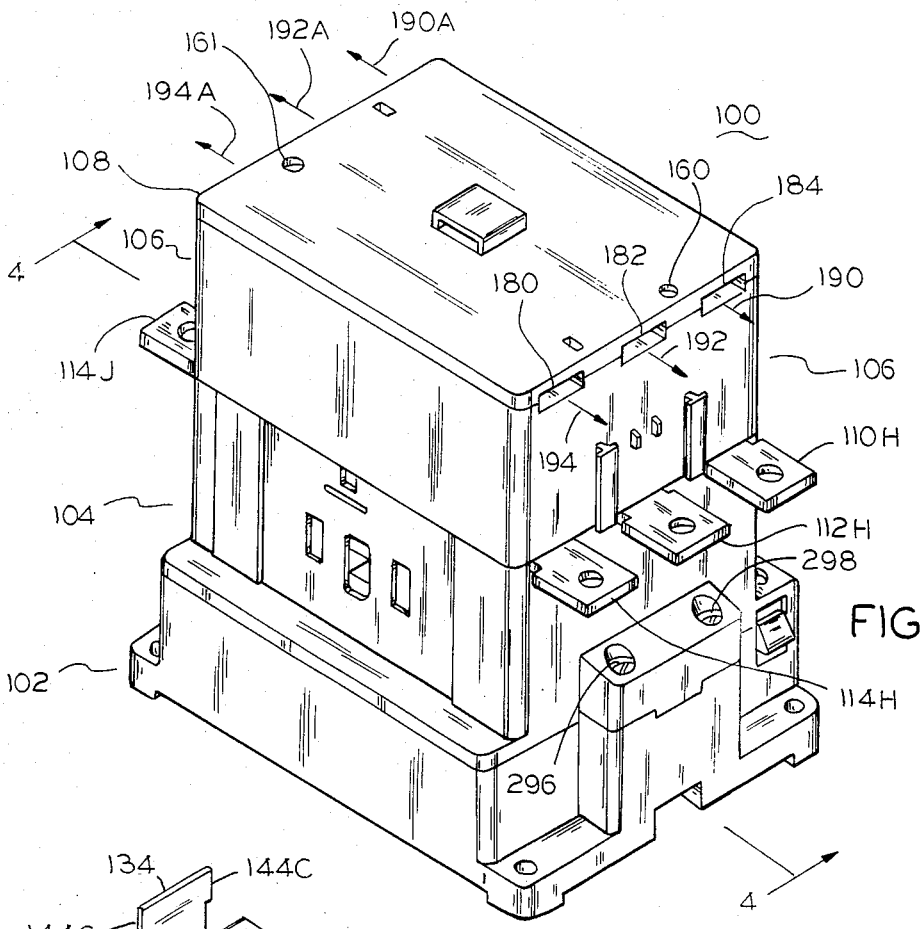
FIG. 2 is an assembled isometric view of an electromagnetic contactor.

An isometric view of an assembled contactor 100 is shown in FIG. 2.

Figure 3:
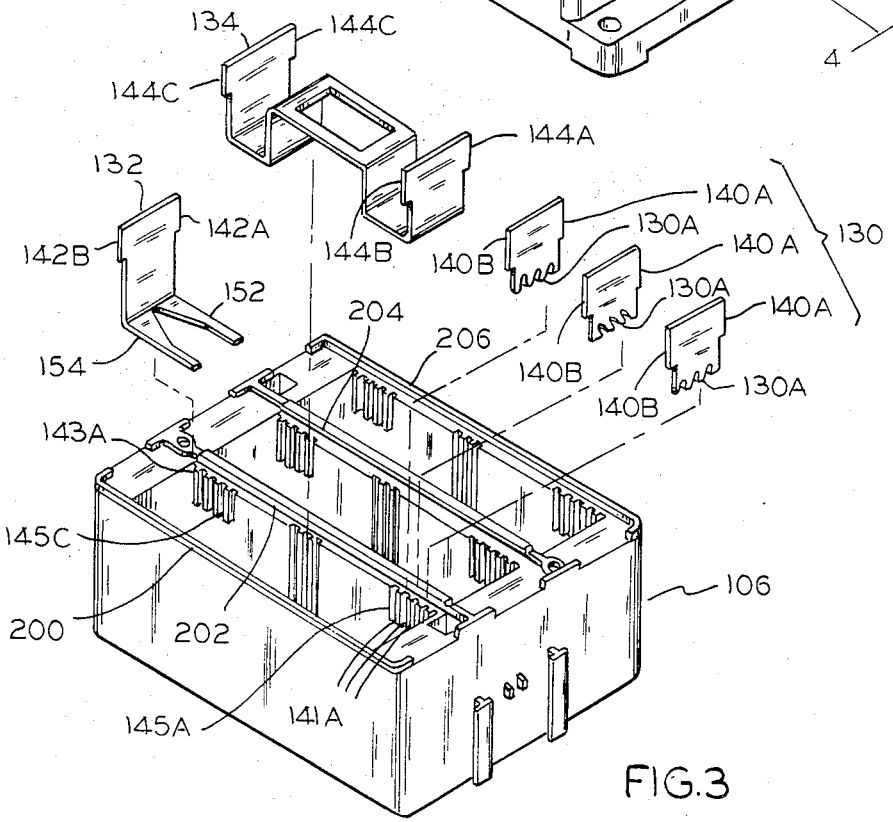
FIG. 3 is an exploded isometric view showing arc quenching plates and their mounting in a housing of the electromagnetic contactor.

Upper housing 106 contains planar arc quenching plates 130, arc runner 132, and arc shorting strap 134, as shown in FIG. 1 and FIG. 3. Details of the insertion of planar arc quenching plates 130, arc runner 132, and arc shorting strap 134 are shown in FIG. 3. Planar arc quenching plates 130 have wings 140A and 140B. Wings 140A, 140B fit into slots 141A, and an opposing slot that is not shown in FIG. 3. Fingers 130A are shown in FIG. 3 as angled in alternate directions on alternate planar arc quenching plates 130, however fingers 130A may alternately be straight in order to facilitate assembly of the device. Likewise, arc runner 132 has wings 142A and 142B which fit into corresponding slots 143A and an opposing slot which is not shown in FIG. 3. Also, arc shorting strap 134 has wings 144A, 144B, 144C and 144D which fit into corresponding slots, for example, wing 144A fits into slot 145A and wing 144C fits into slot 145C. In arc shorting strap 134, wings 144B and 144D fit into corresponding slots which are not shown in FIG. 3.

Figure 6:
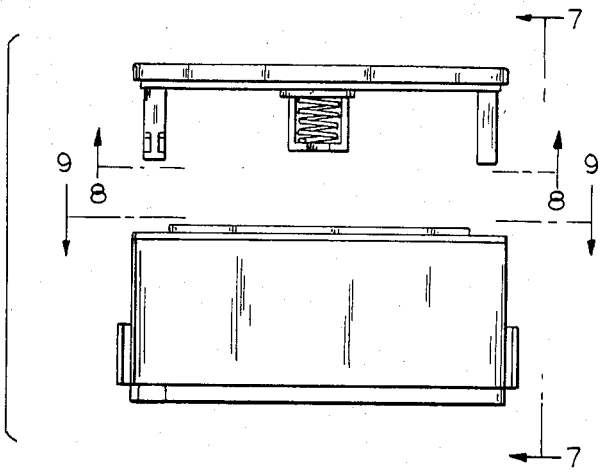
FIG. 6 is a side view of a retaining plate and housing.
Figure 7:
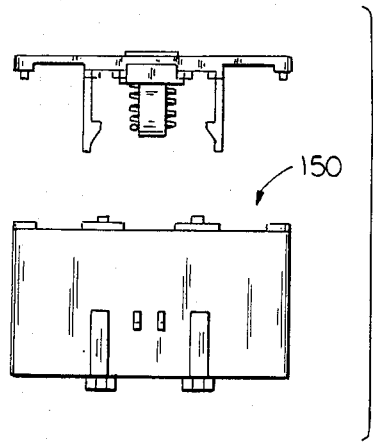
FIG. 7 is an end view of a retaining plate and housing.

As shown in FIG. 3 and FIG. 6, the arc runner 132 may be inserted into housing 106, planar arc quenching plates 130 may also be inserted into housing 106, and also arc shorting strap 134 may be inserted into housing 106, where all of these elements, 130, 132, and 134 are inserted from open side 150 of housing 106. Also, the corresponding arc quenching elements 130, 132, and 134 for each of the six contacts closed by the three contact bridges 110C, 112C, 114C may all be inserted into housing 106 from open side 150 of the housing.

Figure 4:
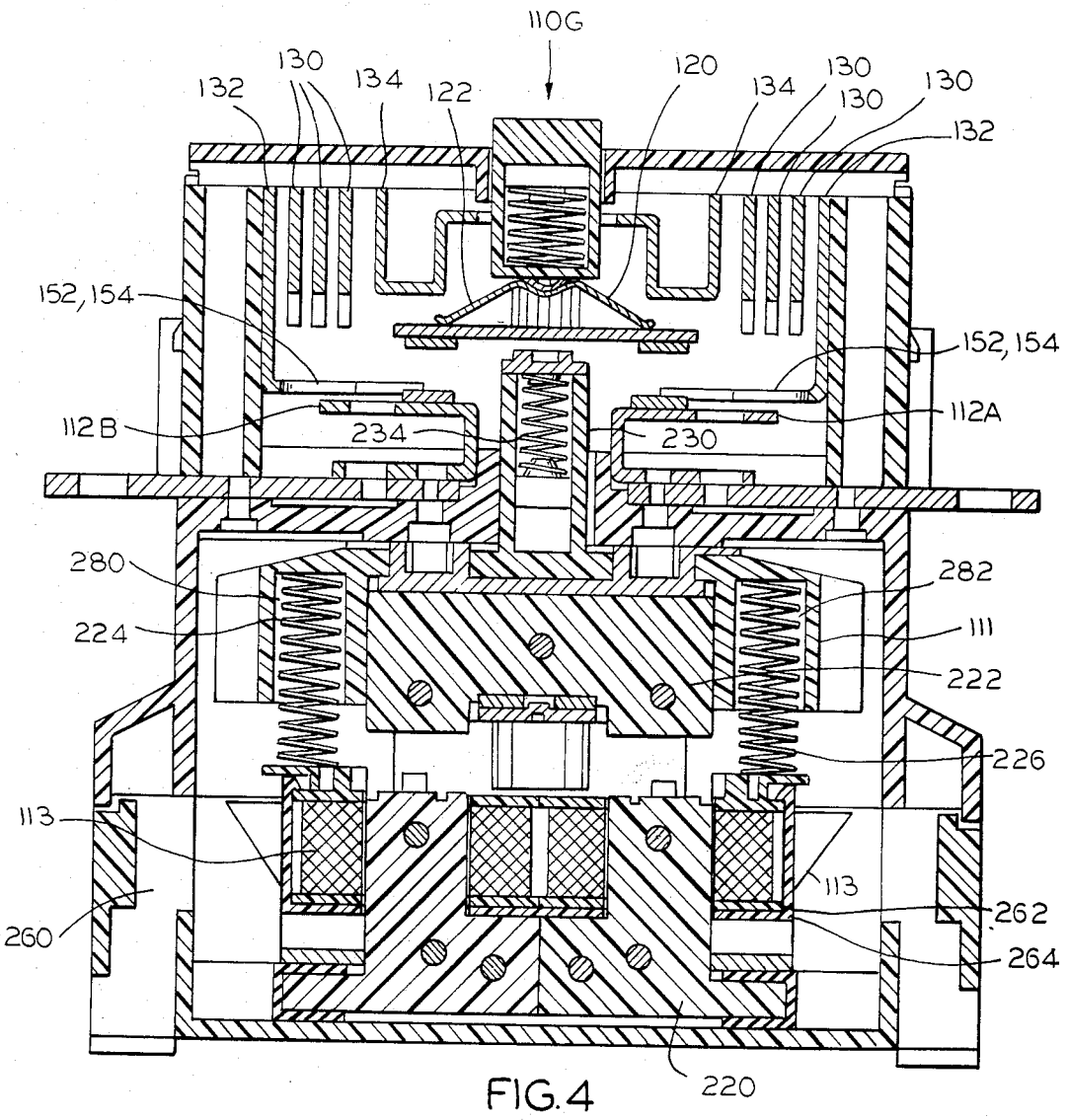
FIG. 4 is a cross-sectional view.
Figure 13:
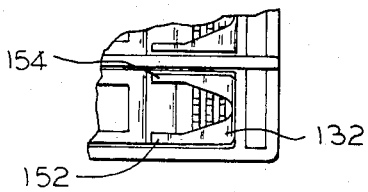
FIG. 13 is a bottom view of a housing taken along line 13—13 as shown in FIG. 11.

FIG. 4 is a cross-sectional view showing planar arc quenching plates 130, arc runners 132, and arc shorting strap 134. As shown in FIG. 4, the level of arms 152 and 154 of arc runner 132 lie just above the level of stationary contact 112A and stationary contact 112B. FIG. 13 shows a bottom view of housing 106, and shows in detail arms 152, 154 of arc runner 132. As shown in FIG. 13, arms 152 and 154 extend with an opening between them. Stationary contacts 112A, 112B fit within and below this opening, as shown in FIG. 4. The cross-sectional view shown in FIG. 4 is taken along the center line of contactor 100 as shown by line 4—4 in FIG. 2. Also, FIG. 4 may be regarded as showing the details of the other contacts, for example contact bridges 110C and 114C, and the associated planar arc quenching plates 130, arc runner 132, and arc shorting strap 134. Leaf springs 120 and 122 are also shown in FIG. 4, pressing against contact bridge 112C.

Figure 5:
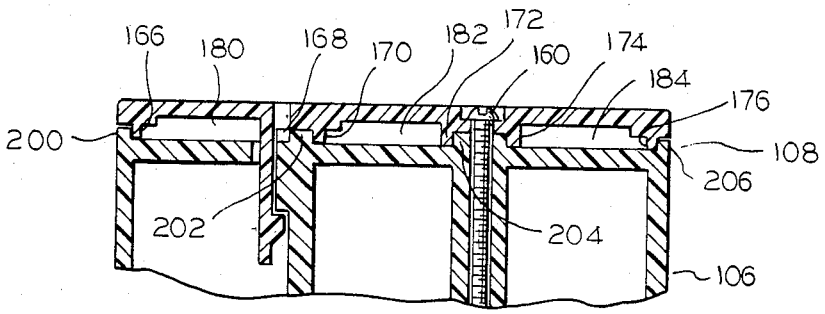
FIG. 5 is a cross-sectional view showing arc gas exhaust ports.
Figure 8:
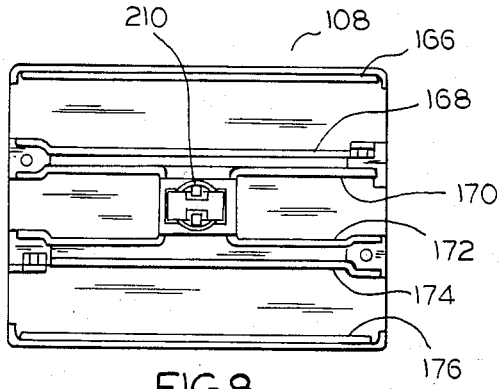
FIG. 8 is a bottom view of a retaining plate.
Figure 10:
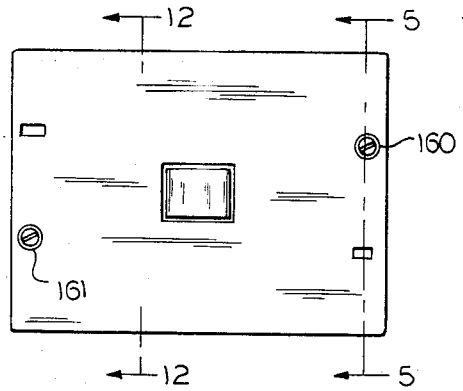
FIG. 10 is a top view of an assembled unit.
Figure 12:
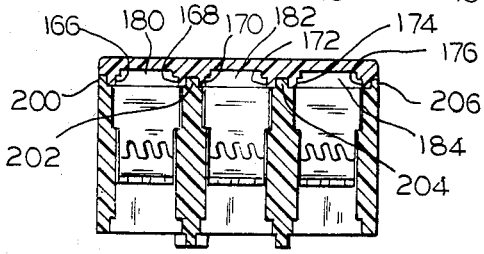
FIG. 12 is a cross-sectional view of a retaining plate and housing taken along line 12—12 as shown in FIG. 10.

Retainer plate 108 attaches to upper housing 106 and middle housing 104 by means of threaded bolts 160, 161, shown in a detailed cross section in FIG. 5. Bolts 160, 161 screw into, for example, metal, threaded receptacle 162 in middle housing 104, as shown in FIG. 1 and FIG. 10. Outwardly extending ridges 166, 168, 170, 172, 174 and 176, as shown in FIG. 12 in cross-section, press against an upper edge of planar arc quenching plates 130, arc runner 132, and arc shorting strap 134. Bolts 160 and 161 firmly attach retainer plate 108 and upper housing 106 to middle housing 104. Ridges 166, 168, 170, 172, 174, and 176 retain the arc suppression system 130, 132, 134, in position in their respective slots in upper housing 106. FIG. 8 is a bottom view of retainer plate 108 and shows ridges 166, 168, 170, 172, 174, and 176. The ridges are, for example, molded into the bottom of retainer plate 108.

Openings 180, 182, and 184 are formed above the arc suppression system, 130, 132, 134 by ridges 166, 168, 170, 172, 174, and 176. As shown in FIG. 8, the ridges extend the full length of retainer plate 108. Thus, openings 180, 182, and 184 extend the full length of retainer plate 108. Openings 180, 182, and 184 are shown in detail in FIG. 5. Exhaust gases produced by arcs formed at the respective contacts may vent from contactor 100 through openings 180, 182, and 184. Arc gases vent from openings 180, 182, 184, in the directions shown by arrows 190, 190A, 192, 192A, and, 194, 194A, as shown in FIG. 2.

Ridges 166, 168, 170, 172, 174, and 176 interlock with projections 200, 202, 204, 206 molded into upper housing 106 as shown in FIG. 3, FIG. 5 and in detail in FIG. 12. Interlocking of the ridges and projections prevent arc gases produced from one set of contacts from mixing with the arc gases produced by another set of contacts. It is important to prevent spillover of arc gases from one set of contacts to another, for example, in order to prevent a phase to phase arc in a three phase electrical circuit.

Figure 9:
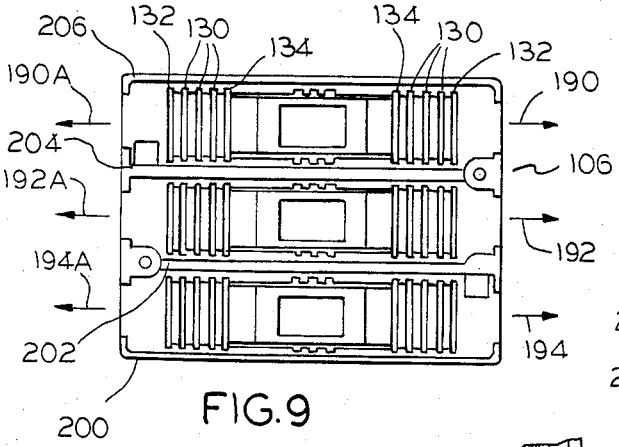
FIG. 9 is a top view of a housing showing arc quenching plates.
Figure 11:
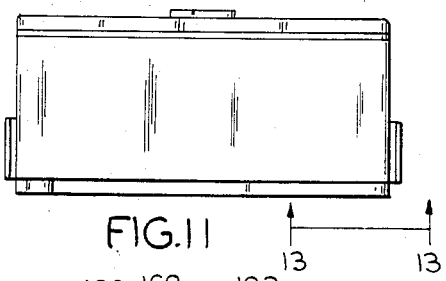
FIG. 11 is a side view of an assembled unit.

A top view of upper housing 106 is shown in FIG. 9, and shows arrows 190, 192, 194, and 190A, 192A, 194A, which show the direction of exhaust of arc gases. FIG. 12 shows projection 200 and ridge 166 interlocking, projection 202 interlocked between ridges 168 and 170, and projection 204 interlocked between ridges 172 and 174, and finally projection 206 interlocked with ridge 176. Openings 180, 182, and 184 are thus seen to be channels which extend parallel to a contact bridge, and extend across the contactor 100.

A very important safety function is performed by openings 180, 182, and 184. In every day use, a contactor 100 as shown in FIG. 2 is normally mounted so that retainer plate 108 lies in a vertical plane. A workman servicing the electrical circuits associated with contactor 100 stands apart from the contactor and faces retainer plate 108. Exhaust gases are directed through openings 180, 182, 184 as shown by arrows 190, 190A, 192, 192A, 194, 194A as shown in FIG. 2. Therefore, the arc gases are directed away from the face of a workman servicing the electrical circuits. By directing the arc gases away from the workman, the openings 180, 182, 184 serve to protect the workman from injury due to expulsion of arc gases by the contactor. Arc gases expelled from the contactor may be particularly serious if the contactor closes the current supply into a short circuit. Thus, the safety aspect of openings 180, 182, 184 serve to protect the workman if a fault condition exists on the load side of contactor 100, and the contactor should close while the workman is in the proximity of the contactor.

Figure 18:
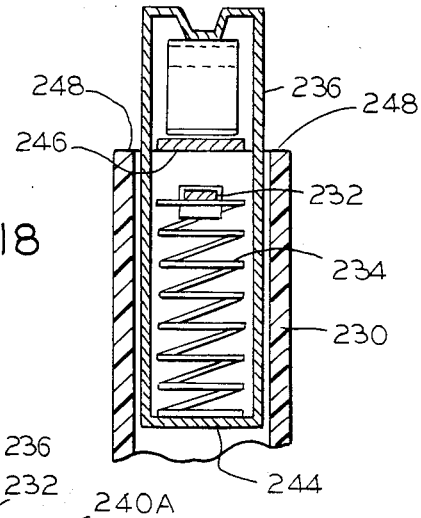
FIG. 18 is a functional section view through a carrier arm taken at right angles to FIG. 4.
Figure 19:
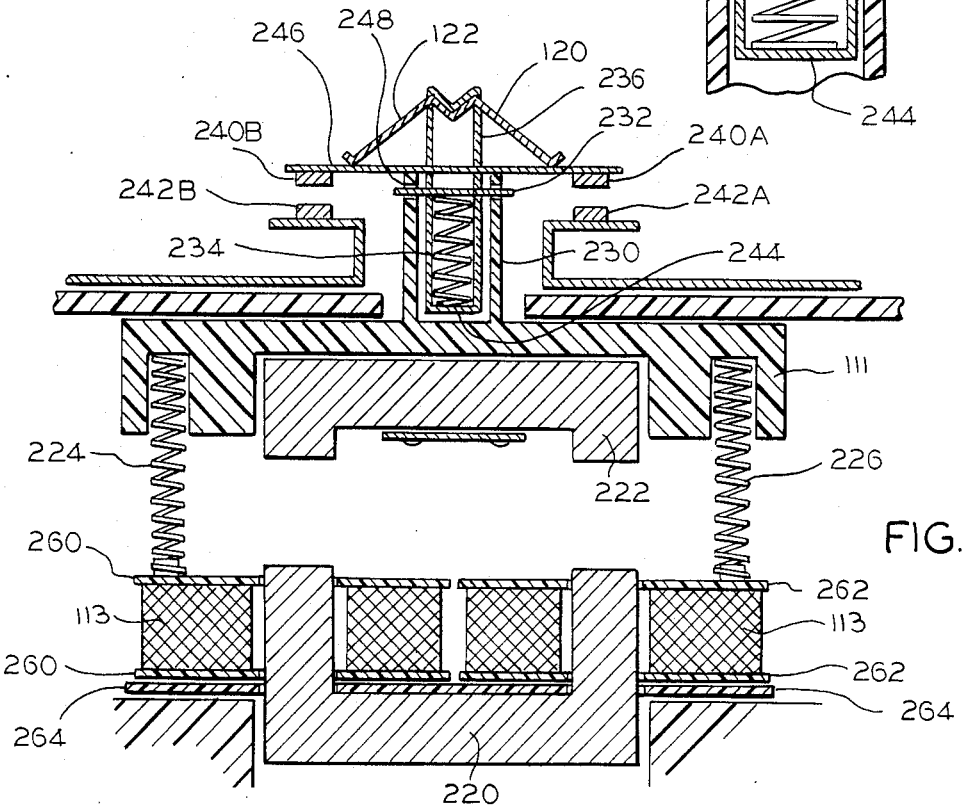
FIG. 19 is a functional section view taken parallel to FIG. 4.

Functional diagrams are shown in FIG. 18 and FIG. 19. FIG. 19 shows the moving parts of contactor 100 and the cooperation between parts. FIG. 18 shows a section view in a plane perpendicular to FIG. 19. FIG. 19 shows the mounting of the contact bridge, including the stirrup which holds the contact bridge to the carrier arm, as described in greater detail hereinbelow.

Figure 15:
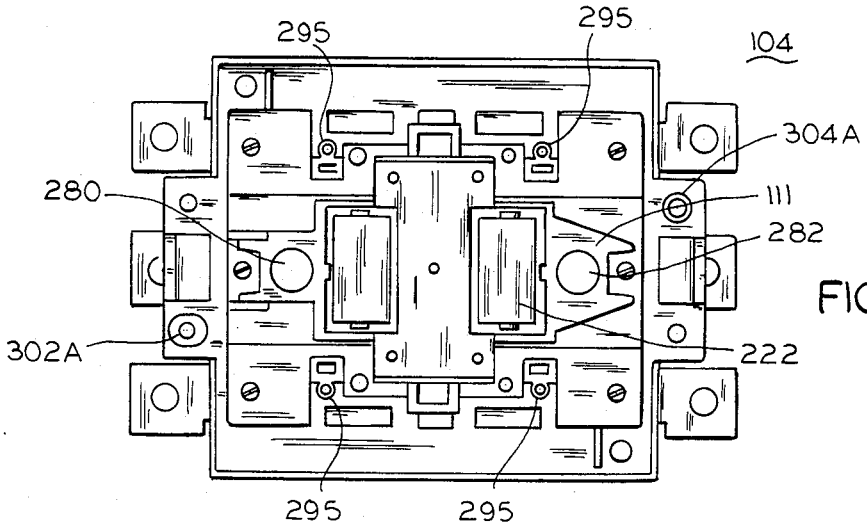
FIG. 15 is a bottom view of a middle housing.

The contacts of contactor 100 are closed by energization of magnet coil 113. Magnet coil 113 is energized by causing an electric current to flow through coil 113. Stationary magnetic core 220, as shown in FIGS. 4, 16, 17, 19, is magnetized by electric current flow through magnet coil 113. Armature 222, as shown in FIGS. 4, 15, 19, is magnetized by current flow through magnet coil 113 and the magnetization of stationary magnetic core 220. An attractive magnetic force develops between armature 222 and stationary magnetic core 220 as a result of electric current flow through magnet coil 113, causing armature 222 to move toward stationary magnetic core 220. The design of contactor 100 allows armature 222 to contact stationary magnetic core 220. The motion of armature 222 toward stationary magnetic core 220 compresses springs 224 and 226. Carrier 111 is attached to armature 222 and moves with armature 222. Arm 230 of carrier 111 also is attached to and moves with armature 222. As shown in more detail in FIGS. 18 and 19, pin 232 is captured by holes in arm 230. Spring 234 bears against pin 232 at one end, and bears against stirrup 236 at the other end. Springs 224, 226 are alternatively referred to as armature return springs.

As armature 222 travels toward stationary magnetic core 220, moveable contacts 240A and 240B travel toward stationary contacts 242A and 242B. The moveable contacts 240A, 240B meet stationary contacts 242A, 242B before armature 222 meets stationary magnetic core 220. As armature 222 continues traveling to meet stationary magnetic core 220 after the moveable contacts have met the stationary contacts, spring 234 is compressed by pin 232 moving closer to the bottom 244 of stirrup 236. Spring 234 is alternately known as a contact pressure spring. Also motion of armature 222 toward stationary contact 220 after the moveable contacts have met the stationary contacts causes flexion of leaf springs 120 and 122.

Contact bridge 246 is seated loosely on top 238 of arm 230, and is held in place by an offset and also by pressure exerted by leaf springs 120, 122. Therefore, contact 240A exerts a force on contact 242A approximately equal to the force exerted by contact 240B upon contact 242B after armature 222 has met stationary magnetic core 220. The approximate equality of the forces between contacts 240A, 242A and contacts 240B, 242B results from spring 234 being compressed and leaf springs 120, 122 being flexed, combined with the loose seating of contact bridge 246 on top 248 of arm 230 and the continued armature travel after the moveable contacts meet the stationary contacts.

Figure 14:
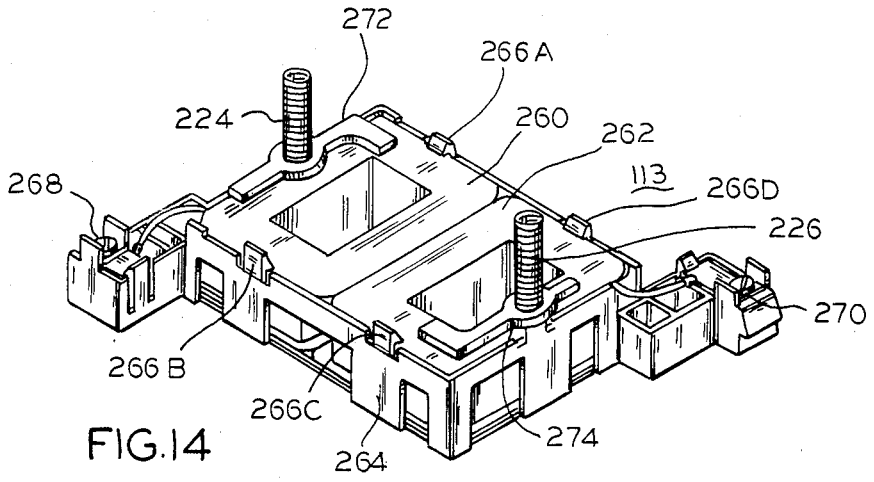
FIG. 14 is an isometric view of a magnet coil assembly.

FIG. 14 is an isometric view of a magnet coil assembly. A coil is wound on bobbin 260, a second coil is wound on bobbin 262, and both bobbins 260, 262 and captured in cup 264. Tabs 266A and 266B lock bobbin 260 into cup 264. Tabs 266C and 266D lock bobbin 262 into cup 264. The coils on bobbins 260, 262 may be, for example, connected in electrical series. Electrical connection to the coils is made through terminals 268, 270. Spring 244 is mounted upon bobbin 260, and in particular stands upon pedestal 272. Pedestal 272 may be, for example, an integral part of the molding which forms bobbin 260. Similarly, spring 226 is mounted upon pedestal 274 which may be an integral part of the molding forming bobbin 262.

Spring 224 fits into hold 280 in carrier 111, and similarly spring 226 fits into hold 282 in carrier 111. Springs 224, 2265 force the contacts of contactor 100 to open after interruption of electric current through magnet coil 113. Springs 224 and 226 perform the dual functions of forcing separation of armature 222 from stationary magnetic core 220 and holding magnet coil assembly 113 firmly against lower housing 102.

Figure 16:
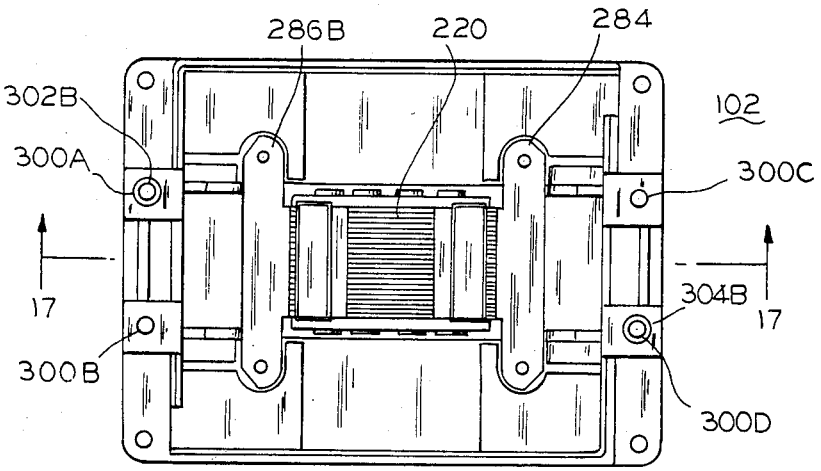
FIG. 16 is a top view of a lower housing.
Figure 17:
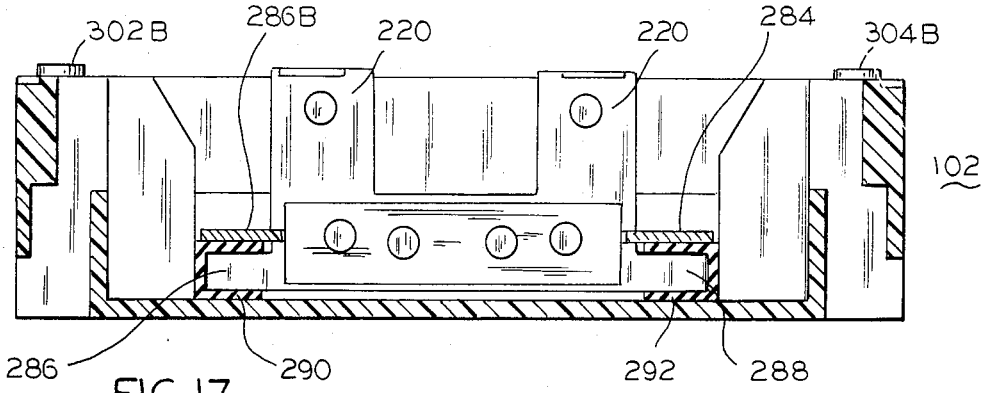
FIG. 17 is a sectional view of a lower housing taken along sectional line 17—17 shown in FIG. 16.

FIG. 16 is a top view of lower housing 102 with the magnet coil assembly 113 removed. Stationary magnetic core 220 is captured in lower housing 102 by retaining strap 284. Retaining strip 284 is attached to lower housing 102 by machine screws. FIG. 17 is a section view taken along line 17—17 shown in FIG. 16. Referring to FIG. 17, projection 286 of stationary magnetic core 220 is captured under retaining strap 286B bolted to lower housing 102. Retaining strap 284 captures projection 288 of stationary magnetic core 220 into lower housing 102. Projection 286 fits into rubber sock 290, and projection 288 fits into rubber sock 292. The rubber socks 290, 292 cushion stationary magnetic core 220 from mechanical shocks, for example the shock of armature 222 meeting stationary magnetic core 220 during operation of contactor 100.

Resilient pads 295, FIG. 15, are attached by snug fit into mounting grooves made into middle housing 104. When middle housing 104 is firmly attached to lower housing 102, resilient pads 295 are compressed by pressing against coil assembly 113. Resilient pads 295 serve to cushion coil assembly 113 from mechanical shocks which arise during operation of contactor 100.

Middle housing 104 is attached to lower housing 102 by machine screws 296, 298, as shown in FIG. 1. A similar pair of screws also holds middle housing 104 to lower housing 102 at the hidden end of FIG. 1, as shown in FIGS. 15, 16. Threaded holes in metal fixtures 300A, 300B, 300C, 300D receive machine screws 296, 298. Raised feature 302B and 304B on lower housing 102 mate with recessed feature 302A and 304A in middle housing 104 in order that the lower and middle housings fit together in only one way.

Alternative Embodiment

FIG. 20 through FIG. 30 show an alternate embodiment of the invention. Lower housing 502, middle housing 504 and upper housing 506 are shown.

It has been found that the embodiment shown in FIG. 1 through FIG. 19 is particularly well suited for contactors of high current carrying capacity, for example for contactors capable of carrying over 200 amperes at 600 Volts AC three phase current. In contrast, the embodiment shown in FIG. 20 through FIG. 30 is useful for lower current carrying capacity, for example, for currents through approximately 50 amperes at 600 Volts AC three phase current.

Figure 20:
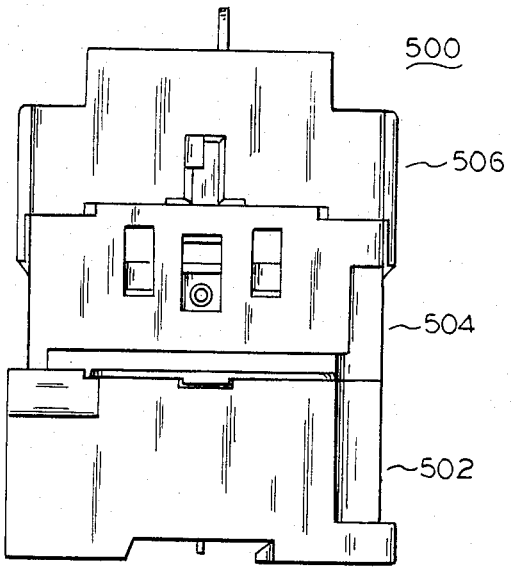
FIG. 20 through FIG. 30 shown an alternative embodiment of the invention.
Figure 21:
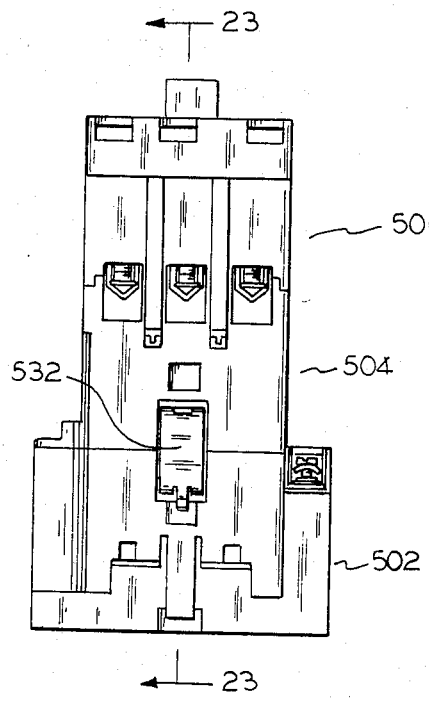

FIG. 20 shows contactor 500 as an assembled unit. Lower housing 502 contains the magnet coil 505 and the stationary magnetic core 507, as shown in exploded view in FIG. 22. Resilient pads 508 are mounted in receiving recesses in lower housing 502 and support magnet coil 505.

Magnet coil 505 comprises a cup 510, and two bobbins 512 and 514 captured within cup 510. Projections 520 and 522 molded into cup 510 locate and support springs 524 and 526. Springs 524 and 526 are alternately referred to as armature return springs.

Middle housing 504 and lower housing 502 are attached together by retaining clips 530 and 532.

Figure 23:
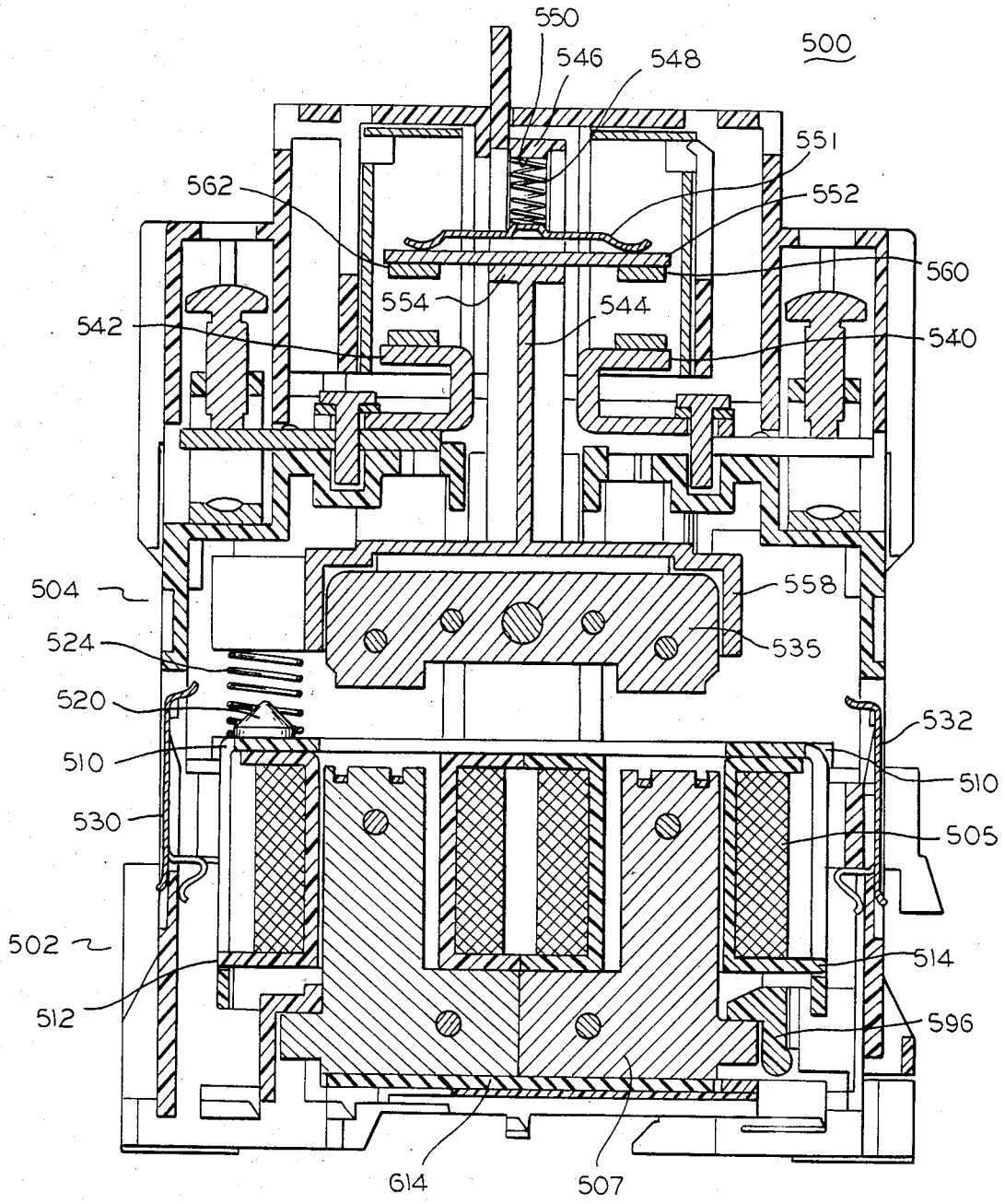

A section view of contactor 500 is shown in FIG. 23. Lower housing 502 is shown holding stationary magnetic core 507, cup 510, and coil bobbins 512 and 514.

Middle housing 504 contains armature 535 and carrier 538. Middle housing 504 also supports stationary contacts 540, 542. Arm 544 of carrier 538 has upper end 546. Spring 548 bears against lower surface 550 of upper end 546 of arm 544 at one end of spring 548, and bears against leaf spring 550 at the other end of spring 548. Spring 548 is alternately referred to as a contact pressure spring. Leaf spring 550 bears against contact bridge 552. Contact bridge 552 rests loosely against platform 554 of arm 544.

When electric current is directed to flow through the coils of magnet coil 505, attractive magnetic force is produced between armature 535 and stationary magnetic core 507. Armature 535 moves into contact with stationary magnetic core 507 under the influence of these magnetic forces, thereby compressing springs 524, 526. Moveable contacts 560, 562 come into contact with stationary contacts 540, 542, respectively, before armature 535 meets stationary magnetic core 507. After the contacts meet, further travel of armature 535 toward stationary magnetic core 507 compresses spring 548 and leaf spring 551. Approximately equal force occurs between contacts 540 and 560 as occurs between contacts 542 and 562 when armature 535 is in contact with stationary magnetic core 507 because contact bar 552 may rotate about platform 554, and spring 548 consequently causes substantially equal force on the two ends of contact bridge 552.

In an alternative embodiment of the invention, leaf spring 550 may be omitted and spring 548 simply bear against contact bridge 552.

Figure 24:
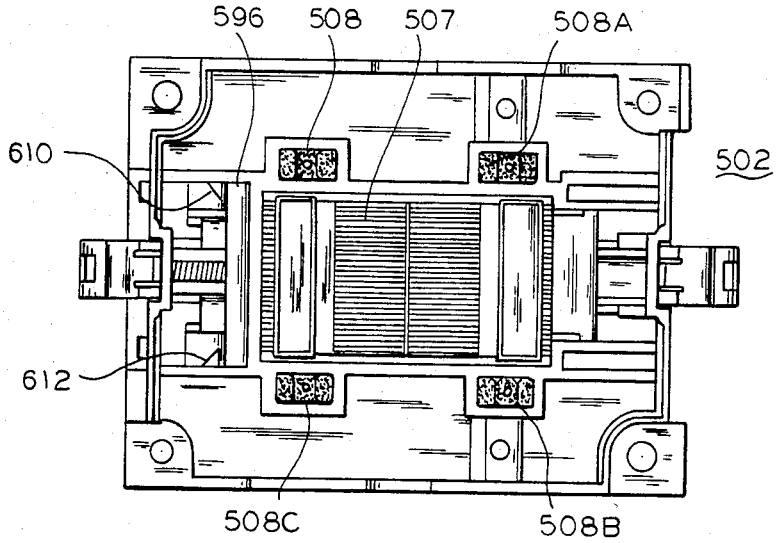

A top view of lower housing 502 is shown in FIG. 24. Resilient pads 508, 508A, 508B, 508C, are shown captured in lower housing 502. The resilient pads support magnet coil assembly 505.

Figure 25:
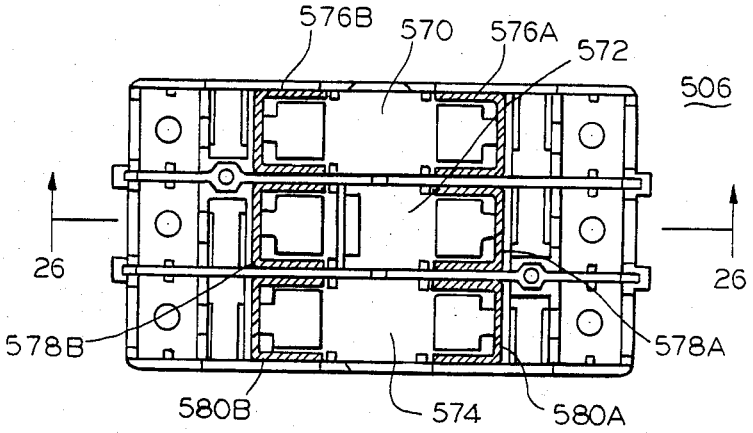

A bottom view of upper housing 506 is shown in FIG. 25. Upper housing 506 is divided into three chambers, 570, 572, 574. Each separate chamber 570, 572, 574, surrounds an individual contact bridge. The separate chambers 570, 572, 574 serve to isolate the contacts for a three phase alternating current circuit which the contactor is used to interrupt. It is important to isolate the phases in order to prevent any electric arc initiated by operation of the contacts from bridging between different phases. Isolation of the contacts for each phase by separate chambers 570, 572, 574 minimizes the risk of a phase to phase arc being established.

Metallic chamber liners 576A, 576B, and liners 578A, 578B, and liners 580A, 580B serve to protect the material of upper housing 506 from an arc produced by opening of the contacts. An arc may be produced by, for example, opening the contacts under load, or for example, closing the contacts into an overload. For example, plastic may be used to make upper housing 506.

Figure 26:
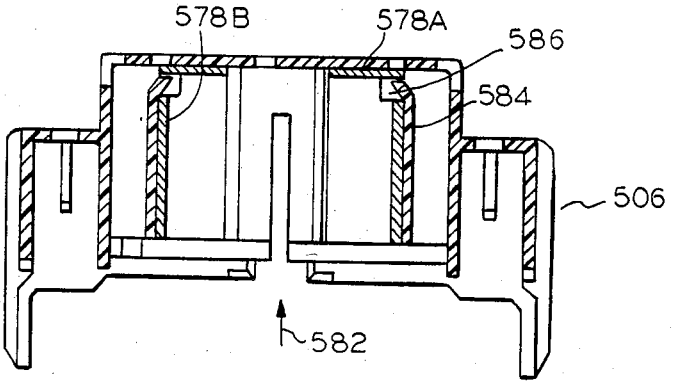

FIG. 26 is a section view of upper housing 506 taken along section line 26—26 shown in FIG. 25. Chamber liners 578A and 578B are shown inserted into upper housing 506. Chamber liners may be inserted into the upper housing from the direction shown by arrow 582. All six chamber liners may similarly be inserted into the upper housing by insertion in the direction shown by arrow 582. As chamber liner 578A is inserted into upper housing 506, plastic tab 584 is deflected. However, after chamber liner 578A reaches its proper position, as shown in FIG. 26, then the plastic tab snaps into opening 586 of chamber liner 578A, thereby preventing removal of the chamber liner 578A. Similarly, all six of the chamber liners are locked into place by plastic tabs similar to plastic tab 584.

Figure 27:
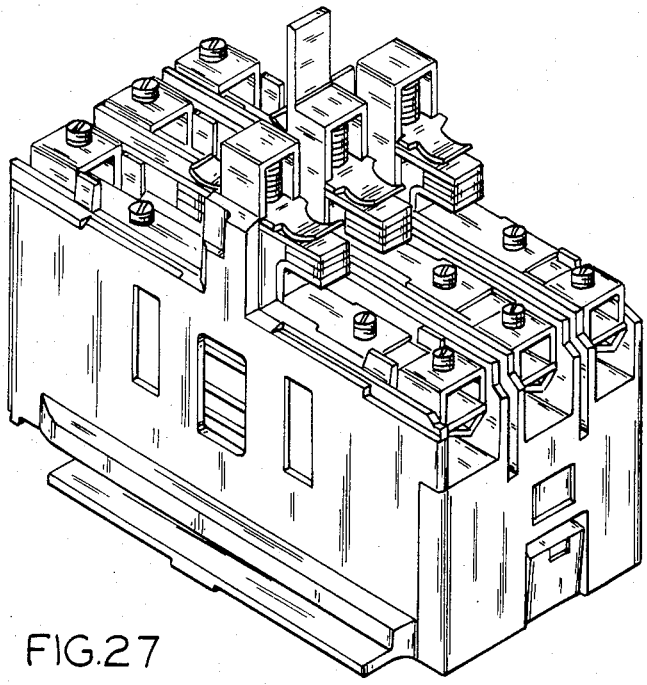

FIG. 27 is an isometric view of middle housing 504 showing three double break contacts. The contact bars have contacts on each end as shown in FIG. 23. Also, when the upper housing is in place, the separate chambers 570, 572, 574, isolate the three double break contacts from each other.

Figure 28:
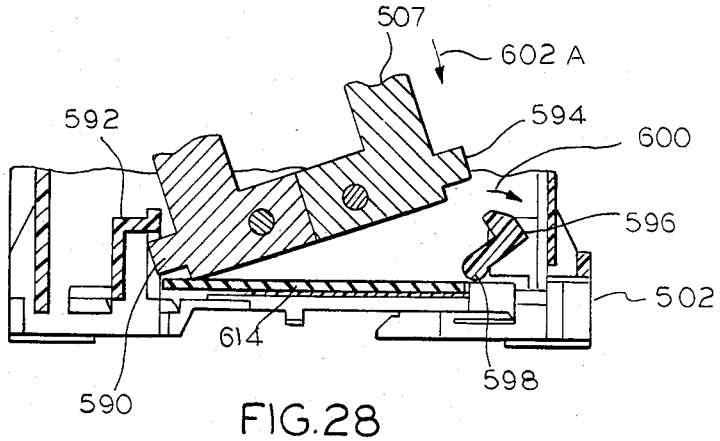
Figure 29:
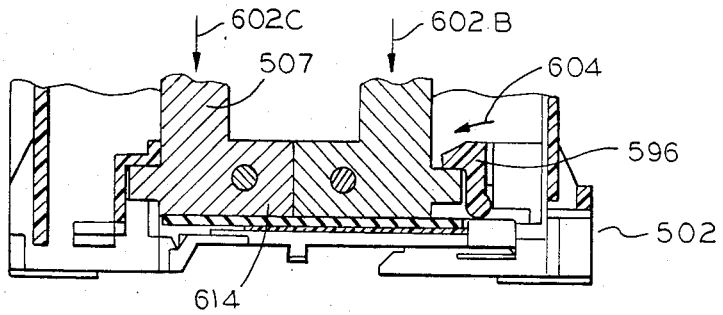

FIG. 28 and FIG. 29 show a mounting arrangement for capturing stationary magnetic core 507 into lower housing 502. Tab 590 fits under molding 592. Tab 594 is captured by dog 596. Dog 596 rotates about axis 598, as shown by arrow 600. Arrows 602A, 602B, 602C show motion of stationary magnetic core 507 as it is assembled into lower housing 502. Arrow 604 shows the rotation of dog 596 as it snaps into locking position to capture stationary magnetic core 507. Fingers 610, 612, (FIG. 24) molded into lower housing 502 lock dog 596 in place. Rubber blanket 614 fits between stationary magnetic core 507 and lower housing 502 and serves to cushion the magnetic core from mechanical shocks such as occur when armature 535 meets the stationary magnetic core 507 during operation of the contactor.

Figure 30:
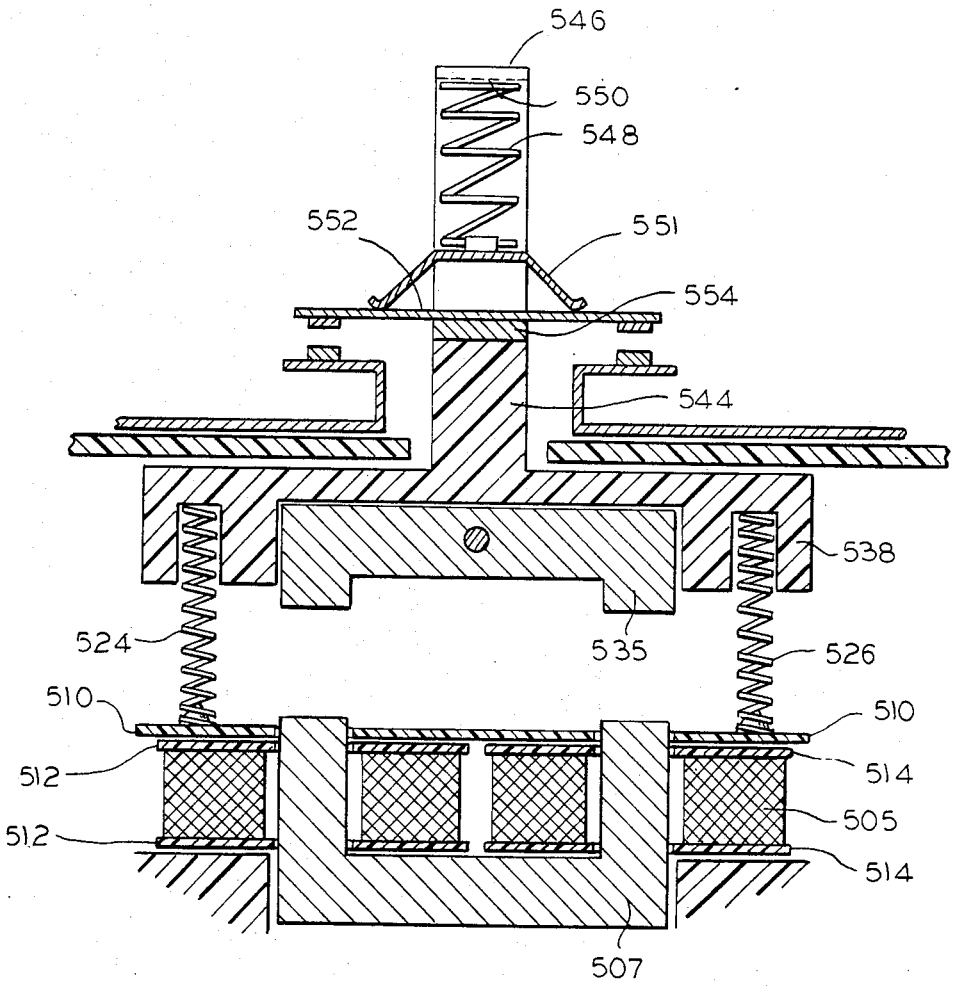

FIG. 30 is a functional diagram of the contactor 500. FIG. 30 isolates the magnetic parts and the moving parts in order to show their cooperation. Although springs 524 and 526 are supported on diagonally opposite corners of cup 524 (FIG. 22), both springs are shown in FIG. 30 because of their function in providing force tending to separate armature 535 and stationary magnetic core 507.

Figure 31:
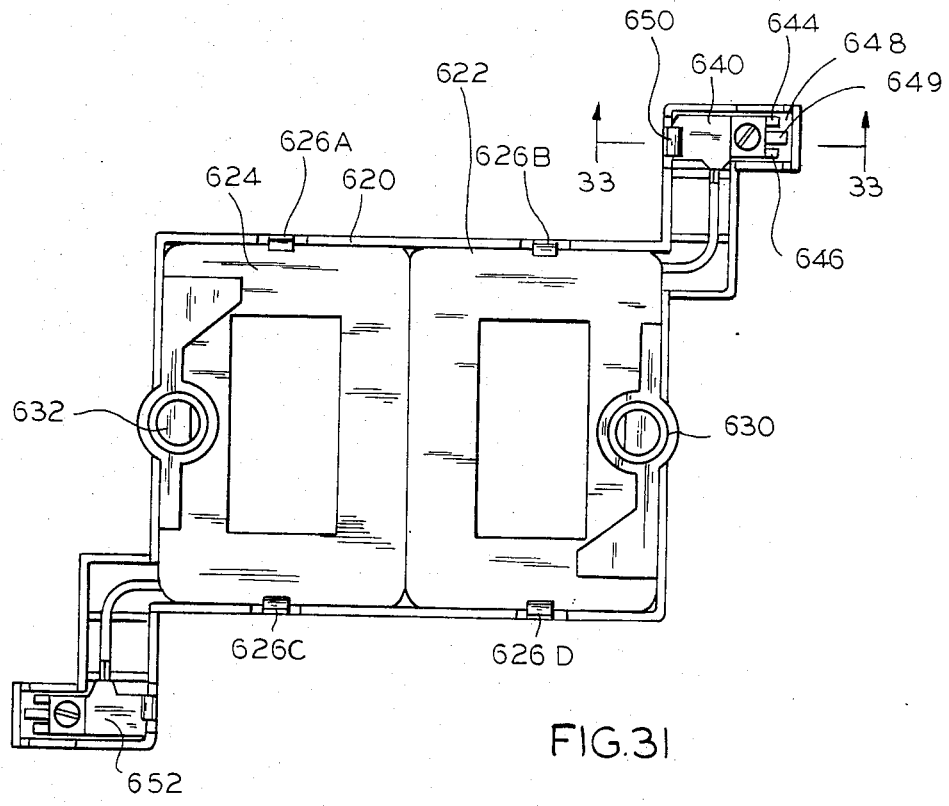
FIGS. 31–33 illustrate an alternate embodiment of a coil assembly.
Figure 32:
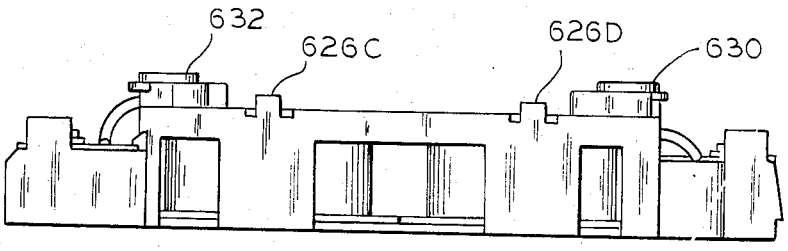
Figure 33:
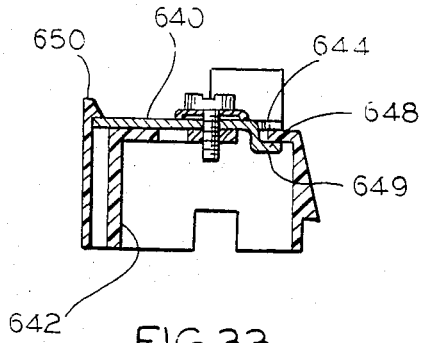

FIG. 31, FIG. 32, and FIG. 33 illustrate an embodiment of a coil assembly suitable for use with the contactor shown in FIGS. 1–19. FIG. 31 is a top view showing a coil cup 620, and two winding bobbins 622, 624. Bobbins 622, 624 are retained in cup 620 by hooks 626A, 626B, 626C, 626D. Hooks 626A, 626B, 626C, 626D are molded into cup 620 and extend over bobbins 622, 624 in order to fasten the bobbins into the cup 620.

Posts 630, 632 are molded into bobbins 622, 624 respectively. Posts 630 and 632 support springs 224, 226 as shown in FIG. 4.

FIG. 33 is a section drawing taken along section line 33—33 shown in FIG. 31. Lug 640 rests upon support 642. A first end of lug 640 has fingers 644, 646 formed on either side of lug 640, and these fingers rest on the upper surface of shelf 648. Finger 649 of lug 640 fits beneath shelf 648. Hook 650 extends over lug 640. Cooperation between shelf 648, fingers 644, 646, 649 and cooperation between support 642, lug 640 and hook 650 fasten lug 640 into cup 620. Lug 640 and lug 652 are terminals for making electrical connection with the coil windings wound on bobbins 622, 624.

Figure 35:
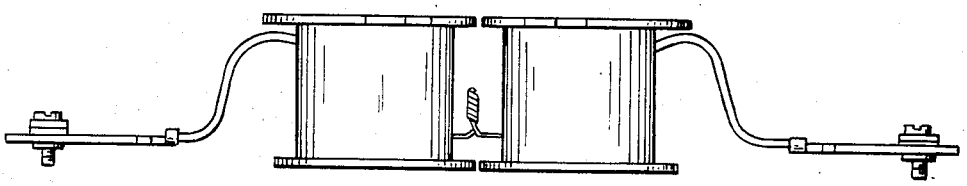

FIG. 35 illustrates two coil bobbins connected in series.

Figure 34:
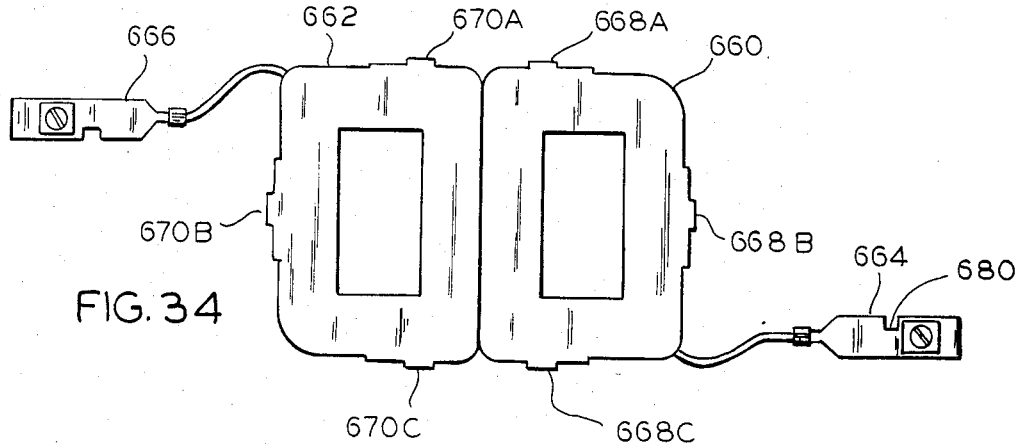
FIGS. 34–43 illustrate an alternate embodiment of a coil assembly.
Figure 36:
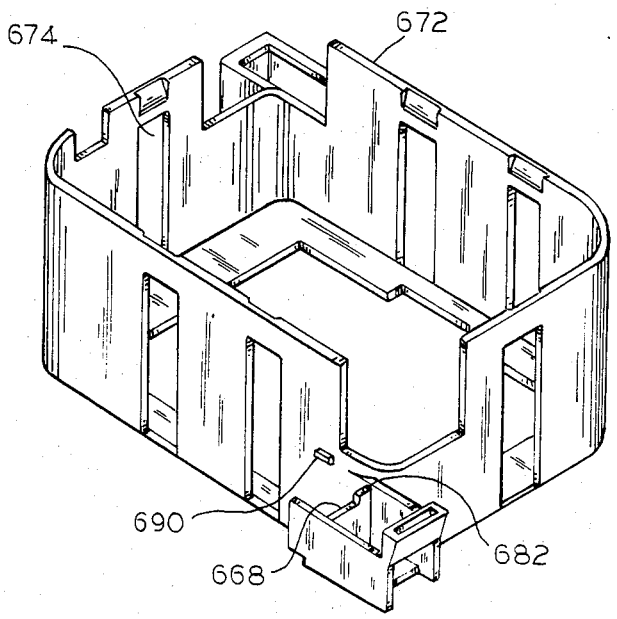
Figure 37:
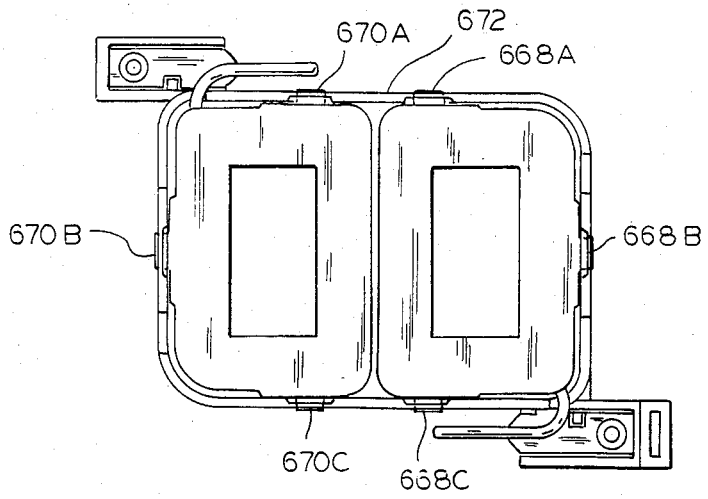
Figure 38:
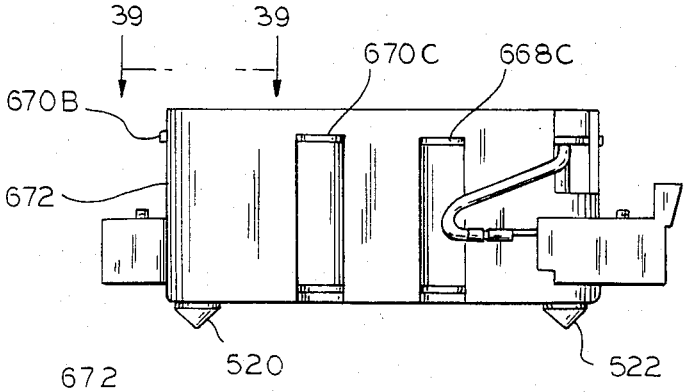
Figure 39:
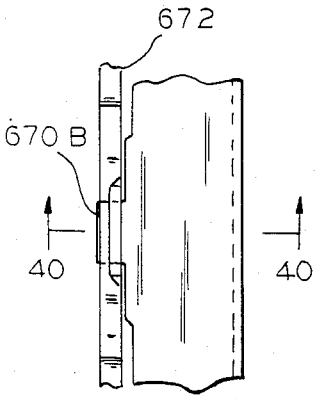
Figure 40:
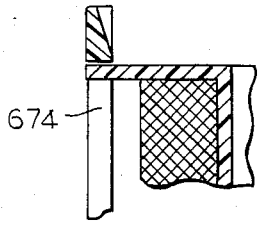

FIGS. 34–43 illustrate a coil assembly suitable for use in a contactor of the type illustrated in FIGS. 20–30. In FIG. 34 there are illustrated bobbins 660, 662 connected to lugs 664, 666. Bobbin 660 has tabs 668A, 668B, 668C. Bobbin 662 has tabs 670A, 670B, 670C. The tabs lock the bobbins into a coil cup 672. FIG. 37 and FIG. 38 illustrate tabs 668A, 668B, 668C and tabs 670A, 670B, 670C locking their respective bobbins into cup 672. FIG. 39 is a top view illustrating tab 670B and its cooperation with cup 672. FIG. 40 is a sectional view taken along line 40—40 shown in FIG. 39 and illustrate tab 670B locked into opening 674 of cup 672.

Figure 22:
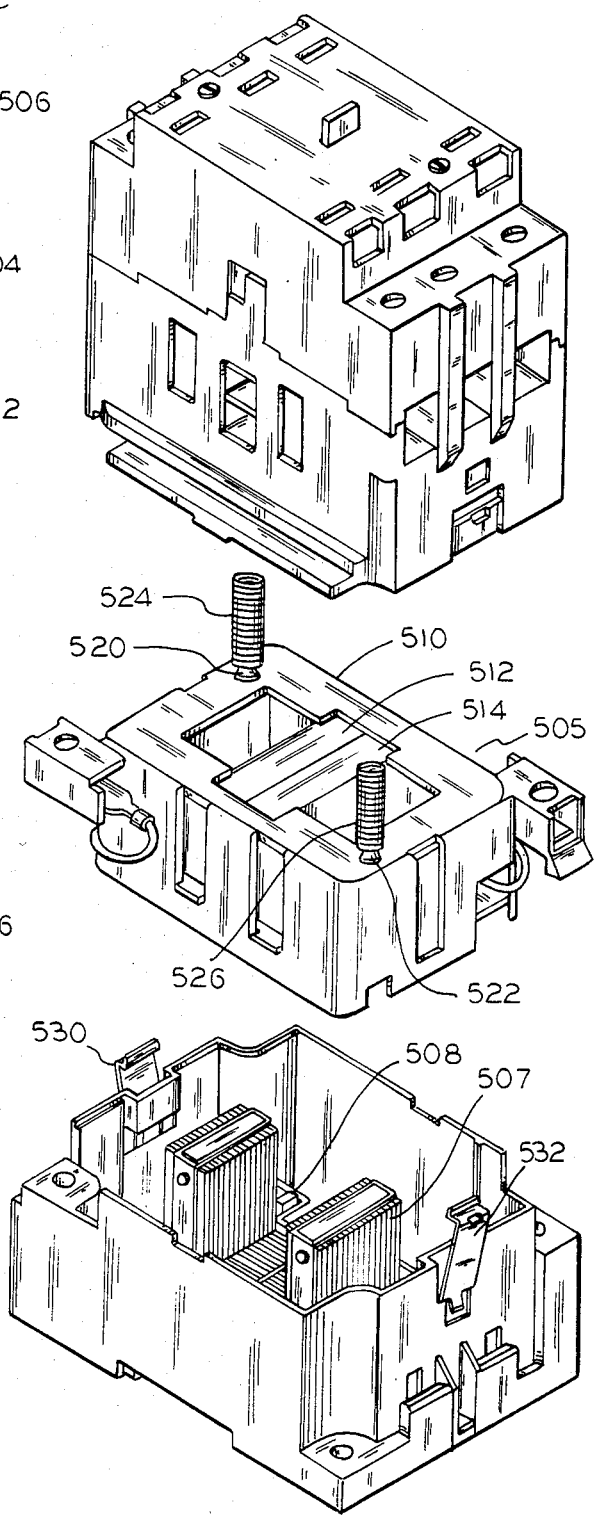

Projections 520, 522 (FIG. 22 and FIG. 38) support springs 524, 526 as is shown in FIG. 22.

Figure 41:
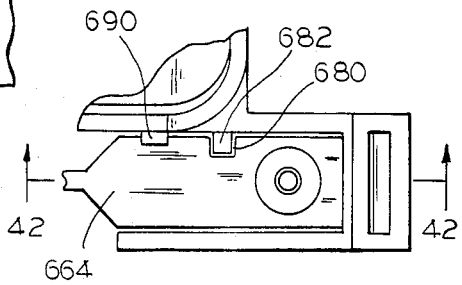
Figure 42:
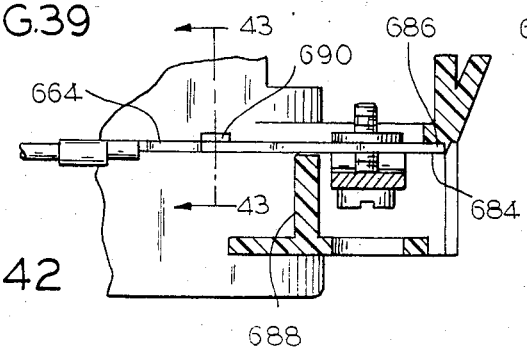
Figure 43:
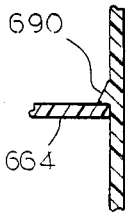

FIG. 41, FIG. 42, and FIG. 43 illustrate the attachment of lugs 664, 666 to cup 672. Recess 680 in lug 664 fits around post 682 (FIG. 36 and FIG. 41). End 684 of lug 664 fits against lip 686 of cup 672. Lug 664 fits against support 688 of cup 672. Lug 664 fits beneath finger 690 of cup 672, as shown in FIG. 42 and FIG. 43. FIG. 43 is a sectional view along line 43—43 shown in FIG. 42. The cooperation of lug 664, lip 686, support 688, post 682, and finger 690 lock lug 664 into cup 672.

Figure 44:
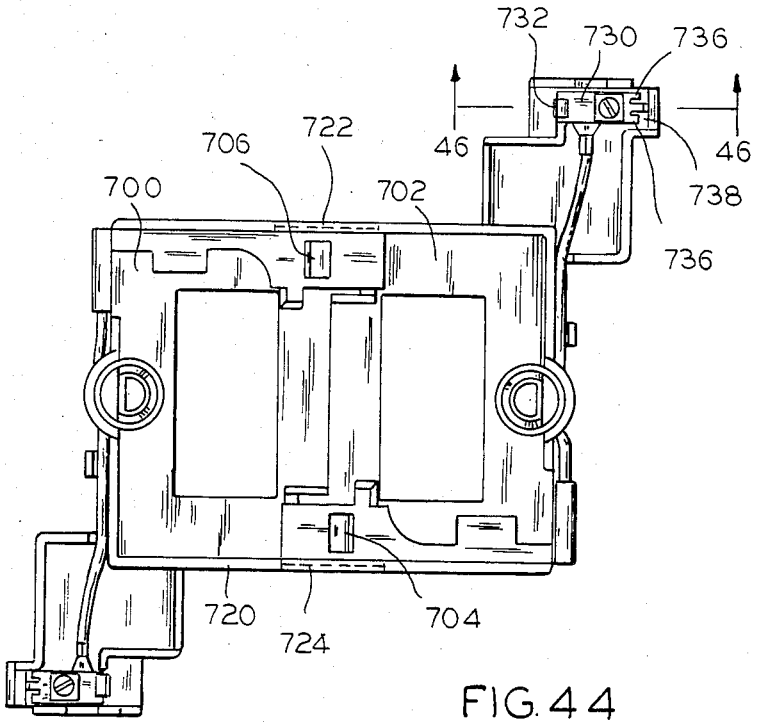
FIG. 44–FIG. 46 illustrate a third alternate embodiment of a coil assembly.
Figure 45:
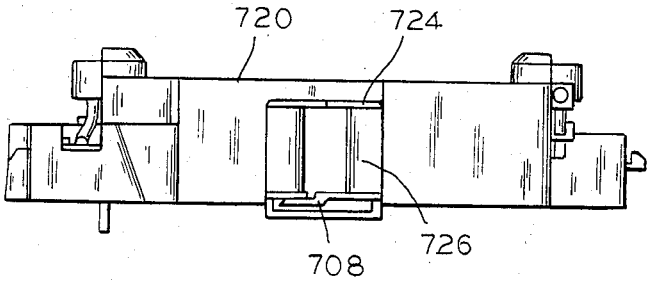
Figure 46:
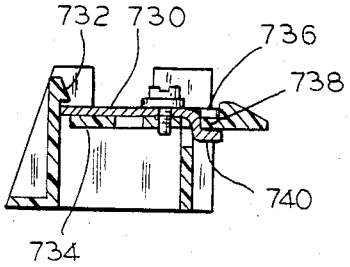

A third alternate embodiment of a coil assembly is shown in FIG. 44, FIG. 45, FIG. 46. Bobbins 700, 702 lock together by means of hooks 704, 706, 708. The bobbin assembly then is locked into cup 720 by means of tabs 722, 724 fitting into openings in cup 720. FIG. 45 illustrates tab 724 fitting into opening 726 of cup 720.

FIG. 46 is a sectional view along line 46—46 shown in FIG. 44, and illustrates fastening of lug 730 into cup 720. Lug 730 fits under hook 732 and rests upon support 734. Fingers 736 of lug 730 extend over shelf 738, and finger 740 of lug 730 extends under shelf 738. Cooperation of lug 730, hook 732, support 734, fingers 736, shelf 738 and finger 740 fasten lug 730 to cup 722. Posts 750, 752 support armature springs.

Parts for contactors may be made out of a variety of plastic materials. For example, for a contactor rated to control a 132 kilowatt motor at 380 volts, three phase alternating current, the following materials have been found to be suitable for the various parts: the upper housing, the middle housing, and the contact carrier may be made from glass reinforced thermoset polyester; and the lower housing may be made of glass reinforced polycarbonate. For contactors designed to control up to 75 kilowatt motors at 380 volts, three phase alternating current, the same materials as used for the 132 kilowatt device have been found to be suitable. For contactors designed to control 37 kilowatt motors of 380 volts three phase alternating current it has been found suitable to use the following materials: for the middle and upper housing, glass reinforced thermoset polyester; for the contact carrier, glass reinforced polyphenylene sulfide; and for the lower housing glass reinforced polycarbonate. For a contactor designed to control a 22 kilowatt motor it has been found suitable to use the following materials, for both an upper and a lower housing, glass reinforced polycarbonate, and contactors of this size may have no middle housing, and further, the carrier may be made of glass reinforced thermoset polyester. In all cases, it has been found suitable to make the coil cup and bobbins from glass reinforced PET, polyethelene teraphthalate thermoplastic polyester. Also, for all sizes of contactors glass filled polycarbonate has been found to be suitable for making a retaining plate for arc quenching plates. Material referred to herein as rubber, for example, rubber supports or rubber mats, may suitably be made from ethylene acrylic. A suitable material for an indicator button has been found to be polycarbonate. Spring seats have been found useful on larger devices, and a suitable material for a spring seat has been found to be glass reinforced PBT, polybutylene teraphthalate thermoplastic polyester. A finger protector has been found useful on these devices, and a finger protector may be made of polypropylene. For making a clip, used to attach a smaller contactor to a DIN rail, type 6/6 nylon has been found to be suitable. An auxiliary contact may have a case and cover made of polycarbonate and a cam made of teflon filled acetal.

It is to be understood that the above-described embodiments are simply illustrative of the principles of the invention. Various other modification and changes may be made by those skilled in the art which will embody the principles of the invention and fall within the spirit and scope thereof.

What is claimed is:

1. An electric switching apparatus comprising:

electric contacts;

arc quenching plates for leading an arc formed by operation of said contacts away from said contacts;

a housing for holding said arc quenching plates, said housing having grooves made into opposing internal walls , said arc quenching plates being insertable from said first side of said housing into said grooves;

a retainer for holding said arc quenching plates in place in said grooves; and, at least one exhaust channel between said housing and said retainer, said exhaust channel also formed between said retainer and said arc quenching plates, for exhaust of arc gases in a direction substantially parallel to a plane of said retainer and substantially perpendicular to a plane of said arc quenching plates.

2. The apparatus as in claim 1 wherein said retainer further comprises a substantially planar plate.

3. The apparatus as in claim 1 wherein said apparatus further comprises:

at least one exhaust channel between said housing and said retainer for exhaust of arc gases in a direction substantially parallel to a plane of said retainer and substantially perpendicular to a plane of said arc quenching plates.

4. The apparatus as in claim 1 wherein said electric contact comprises double break contacts having a movable contact bridge.

5. The apparatus as in claim 4 wherein both contacts of said movable double break contact bridge have said arc quenching plates associated therewith.

6. The apparatus as in claim 1 wherein said arc quenching plates further comprise:

an arc runner having a substantially V shape with substantially parallel extensions from the V arranged so that one extension lies on opposing sides of said contact;

at least one substantially planar arc quenching plate; and, at least one arc shorting bar arranged to provide an arc conduction path between each of said contacts at each end of a double break contact formed by a movable contact bridge.

7. The apparatus as in claim 1 wherein said electric contacts further comprise at least three double break contacts arranged for interrupting three phase alternating current.

8. The apparatus as in claim 1 wherein said arc quenching plates further comprise substantially planar arc quenching plates having at least one finger located proximate to said electric contacts for transferring an arc from said contacts to said arc quenching plates.

9. The apparatus as in claim 1 wherein said arc quenching plates further comprises at least one arc runner having two arms arranged in a plane substantially perpendicular to a plane of substantially planar arc quenching plates, wherein said two arms are arranged proximate to opposite sides of said contact.

10. The apparatus as in claim 1 wherein said retainer further comprises:

at least two ridges formed in said retainer and protruding toward said arc quenching plates to hold said arc quenching plates in place, said exhaust channel formed as a space bounded by said at least two ridges, said retainer, and said arc quenching plates.

11. A method for mounting arc quenching plates for an electric switching apparatus having electric contacts comprising:

forming grooves into opposing internal walls of a housing so that said grooves extend from a first side of said housing for a predetermined distance into said housing, said arc quenching plates being insertable from said first side of said housing into said grooves;

inserting said arc quenching plates into said grooves;

retaining said arc quenching plates in said grooves by attaching a retainer to said first side of said housing;

forming an exhaust channel between said housing and said retainer, said exhaust channel also formed between said retainer and said arc quenching plates, for exhaust of arc gases in a direction substantially parallel to a plane of said retainer and substantially perpendicular to a plane of said arc quenching plates.

12. An electric switching apparatus comprising:

at least one electric contact;

at least one arc chamber liner for quenching an arc formed by operation of said contact;

a housing for holding said at least one arc chamber liner, said at least one arc chamber liner being insertable into said housing from a first side of said housing;

at least one finger molded into said housing, said at least one finger being deflected by said at least one arc chamber liner as it is being inserted into said housing, said at least one finger seating in a receiving structure, and said at least one finger preventing removal of said at least one arc chamber liner after said at least one finger seats in said receiving structure.

13. The apparatus as in claim 12 wherein said at least one electric contact is three double break contacts for switching a three phase alternating current load.

14. The apparatus as in claim 13 wherein said at least one arc chamber liner is six arc chamber liners, one for each contact of said double break contacts, and said at least one finger is six fingers, one for each arc chamber liner.

15. The apparatus as in claim 12 wherein said receiving structure for said at least one finger is an opening between a first side and a top of said at least one arc chamber liner so that said at least one finger enters said opening and bears against said top of said at least one arc chamber liner so as to prevent removal of said at least one arc chamber liner.

16. An electric switching apparatus comprising:

electric contacts;

arc quenching plates for leading an arc formed by operation of said contacts away from said contacts;

a housing for holding said arc quenching plates, said housing having grooves made into opposing internal walls, said arc quenching plates being insertable from said first side of said housing into said grooves;

a retainer for holding said arc quenching plates in place in said grooves;

at least one exhaust channel between said housing and said retainer, said exhaust channel also formed between said retainer and said arc quenching plates, for exhaust of arc gases in a direction substantially parallel to a plane of said retainer and substantially perpendicular to a plane of said arc quenching plates; and, at least two ridges formed in said retainer and protruding toward said arc quenching plates to hold said arc quenching plates in place, said exhaust channel formed in a space bounded by said at least two ridges; said retainer, and said arc quenching plates.

17. A multiphase alternating current electric switching apparatus comprising:

at least one set of arc quenching plates for each said phase;

a housing for holding said arc quenching plates;

at least one dividing wall within said housing for forming a plurality of chambers, one chamber for each said at least one set of arc quenching plates used for a respective alternating current phase;

a retainer for holding said arc quenching plates in said housing;

means for interlocking said retainer with said housing and with said at least one dividing wall for separating said chambers to prevent exhaust gases produced in one said chamber, by one said alternating current phase, from mixing with exhaust gases produced in another said chamber by another said alternating current phase; and, at least one exhaust channel between said housing and said retainer for each said chamber, said at least one exhaust channel for exhaust of arc gases in a direction substantially parallel to a plane of said retainer and substantially perpendicular to a plane of said arc quenching plates, thereby providing exhaust of arc gases and preventing mixing of said arc gases formed by electric current flowing in different of said alternating current phases.

18. The apparatus as in claim 17 wherein said means for interlocking said retainer and said at least one dividing wall comprises:

at least one ridge formed in the top of each said at least one dividing wall; and, at least one groove formed into said retainer, so that each said groove accepts a respective said ridge, thereby forming a joint sufficiently tight to prevent intermixing of arc gases between said chambers.

19. The apparatus as in claim 18 wherein said means for interlocking said retainer and said two dividing walls comprises:

a ridge formed in the top of each said two dividing walls; and, two grooves formed into said retainer, so that each said groove accepts a respective said ridge, thereby forming a joint sufficiently tight to prevent intermixing of arc gases between said chambers.

20. A three phase alternating current electric switching apparatus comprising:

three sets of arc quenching plates, one said set for each phase;

a housing for holding said arc quenching plates;

two dividing walls within said housing for forming three chambers, one chamber for each said three sets of arc quenching plates used for a respective alternating current phase;

a retainer for holding said arc quenching plates in said housing;

means for interlocking said retainer with said housing and with said at least one dividing wall for separating said chambers to prevent exhaust gases produced in one said chamber, by one said alternating current phase, from mixing with exhaust gases produced in another said chamber by another said alternating current phase; and, at least one exhaust channel between said housing and said retainer for each said chamber, said at least one exhaust channel for exhaust of arc gases in a direction substantially parallel to a plane of said retainer and substantially perpendicular to a plane of said arc quenching plates, thereby providing exhaust of arc gases and preventing mixing of said arc gases formed by electric current flowing in different of said alternating current phases.

21. A three phase alternating current electric switching apparatus comprising:

three sets of arc quenching plates, one said set for each phase;

a housing for holding said arc quenching plates;

two dividing walls within said housing for forming three chambers, one chamber for each said three sets of arc quenching plates used for a respective alternating current phase;

a retainer for holding said arc quenching plates in said housing;

a ridge formed in the top of each said two dividing walls;

two grooves formed in said retainer, so that each said groove accepts a respective said ridge, thereby forming a joint sufficiently tight to prevent intermixing of arc gases between said chambers; and, at least one exhaust channel between said housing and said retainer for each said chamber, said at least one exhaust channel for exhaust of arc gases in a direction substantially parallel to a plane of said retainer and substantially perpendicular to a plane of said arc quenching plates, thereby providing exhaust of arc gases and preventing mixing of said arc gases formed by electric current flowing in different of said alternating current phases.

* * * * *